United States Patent [19]

Boujet et al.

[11] Patent Number: 4,465,989

[45] Date of Patent: Aug. 14, 1984

[54] TEMPERATURE-STABILIZED MICROWAVE FILTER

[75] Inventors: Jean-Pierre Boujet, Chatillon; Gérard Gaille, Bruyères le Chatel; Charles Jousselin, Draveil, all of France

[73] Assignee: Compagnie Industrielle Des Telecommunications, Paris, France

[21] Appl. No.: 435,446

[22] Filed: Oct. 20, 1982

[30] Foreign Application Priority Data

Oct. 29, 1981 [FR] France ..... 81 20296

[51] Int. Cl.[3] ..... H01P 1/208; H01P 7/06

[52] U.S. Cl. ..... 333/209; 333/212; 333/232; 333/253

[58] Field of Search ..... 333/202–212, 333/219–235, 253, 263

[56] References Cited

U.S. PATENT DOCUMENTS 3,528,042 9/1970 Weinberger ..... 333/229

FOREIGN PATENT DOCUMENTS 2326077 4/1977 France ..... 333/212

*Primary Examiner*—Marvin L. Nussbaum

*Attorney, Agent, or Firm*—Sughrue, Mion, Zinn, Macpeak and Seas

[57] ABSTRACT

In a temperature-stabilized microwave filter, each resonant cavity (5) is tuned by means of a tuning rod (10) of a thermally stable material. A first end of each tuning rod (10) extends into the respective cavity (5) without touching its surface. A second end is clamped, remotely of the cavity (5), into the filter body (1–2). At the position of this second end the filter body (1–2) has a bore (13) of substantially the same diameter as the tuning rod (10). The tuning rods (10) are clamped by pairs of retaining screws (15) accommodated in clearance holes in the filter body on one side of a longitudinal groove (21) intersecting the bore (13) and anchored into the filter body (1–2) on the other side of the groove (21).

5 Claims, 6 Drawing Figures

TEMPERATURE-STABILIZED MICROWAVE FILTER

BACKGROUND OF THE INVENTION

1. Field of the Invention

The present invention concerns temperature-stabilized microwave filters. It is more particularly concerned with resonant cavity filters in which tuning screws are used for final electrical adjustment of the cavities and temperature stabilization of the filter, in other words maintenance of the electrical response characteristics of the filter over a wide range of temperatures.

2. Description of the Prior Art

It is known to constitute a microwave filter by means of coupled resonant cavities. The resonant frequency in each cavity is determined by the dimensions of the cavity.

Precise adjustment of the electrical length of each resonant cavity is obtained by means of a tuning screw, of metal or preferably of an insulating material, inserted through a wall of the cavity and extending to a varying degree into the cavity so as to tune the cavity to the required frequency. These screws avoid the need for accurate machining of the cavity and final adjustment of the cavity dimensions, operations incompatible with mass production, and provide the final adjustment of the cavity resonant frequency.

Filters manufactured in the usual manner from brass or aluminum and tuned in the manner described hereinabove are nevertheless subject to frequency drift when the metal of which they are constituted expands or contracts with variations in the ambient temperature. This drift in the tuned frequency of each cavity is caused by mechanical variations in the length of the cavity and the larger dimension of the transverse cross-section of the cavity, increasing the cavity volume when the temperature increases and so reducing the tuned frequency.

In order to compensate for this tuning drift as a function of temperature, it is known to use tuning screws of a thermally stable material attached to the body of the filter in such a way that they move outwardly relative to the cavities when the filter body expands. When the tuning rod moves outwardly relative to the cavity, the cavity tuned frequency is increased.

In French Pat. No. 2 326 077, adjustment of the cavity tuned frequency and temperature compensation of the cavity tuning drift and filter passband drift are obtained using tuning screws with shanks made from a thermally stable material and threaded ends screwed into the body of the filter forming, for each screw and in each cavity, a tubular support delimiting a conduit longer than the wall of each cavity with which the shank projecting into the cavity does not come into contact. For example, the shank consists of a quartz cylinder bonded to a threaded end made from an alloy material known as Invar. Appropriate selection of the diameter and length of the quartz shank and its anchor point provides very good compensation of frequency drift with temperature.

While the operation of the filters obtained in this way is satisfactory, it is nevertheless the case that their cost is high. Also, mating without play of the thread of the screw end with the thread in the filter body is a difficult operation ruling out large-scale industrial manufacture of these filters.

An objective of the present invention is to propose a considerably simplified filter construction based on the same fundamental idea as the aforementioned disclosure, that is to say displacing the point of attachment of the tuning screw of the cavity concerned. The filter in accordance with the invention is made by mechanical machining at low cost.

SUMMARY OF THE INVENTION

The present invention consists in a microwave filter comprising a body, resonant cavities machined into said filter body and coupled to one another, a respective tuning rod for each of said cavities fabricated from a thermally stable material and having a first end extending into the respective cavity without touching the surface thereof, bores in said filter body which open onto one of its surfaces and into one of said cavities, end portions of said bores opposite said cavities having a diameter substantially equal to the diameter of said tuning rods, and substantially constant pressure means for fastening a second end of each of said rods into said end portion of said bore accommodating it.

In accordance with another feature of the invention, a longitudinal groove intersects said end portions of said bores substantially coincident with their median axis and to their full height.

In accordance with a further feature of the invention, said fastening means comprise transversely disposed screws on each side of each of said tuning rods in the area of said end portions of said bores accommodating said tuning rods, passing through clearance holes on one side of said groove and being threaded into retaining holes on the other side of said groove aligned with said clearance holes.

In accordance with a yet further feature of the invention, said screws and said end portions of said bores are so dimensioned that the ratio of the length of that portion of each screw between its head and its anchor point to the diameter of said end portions of said bores is substantially equal to the ratio of the coefficient of linear expansion of the material of said filter body to the difference between that coefficient and the coefficient of linear expansion of said screws, the material of which has a coefficient of linear expansion less than that of the material of said filter body.

Other objects and advantages will appear from the following description of an example of the invention, when considered in connection with the accompanying drawings, and the novel features will be particularly pointed out in the appended claims.

DESCRIPTION OF THE PREFERRED EMBODIMENT

Figure 1:
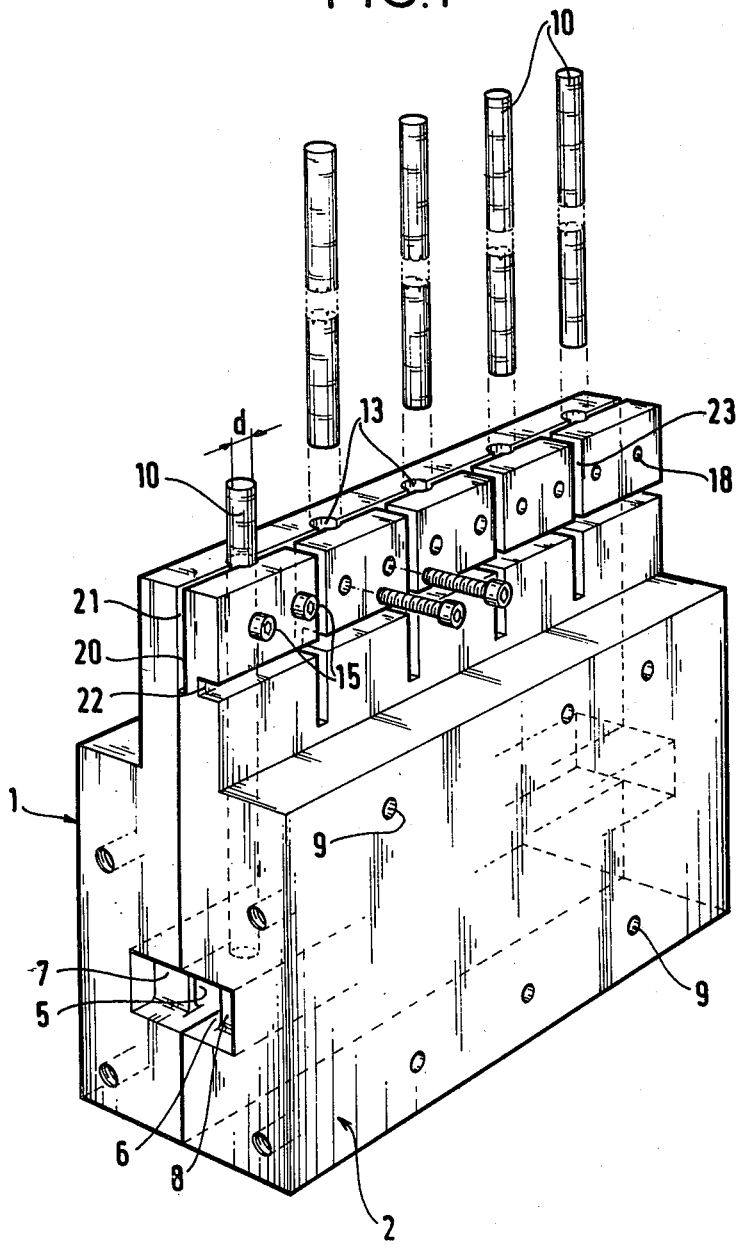
FIG. 1 is a perspective view of a microwave filter in accordance with the invention.
Figure 2:
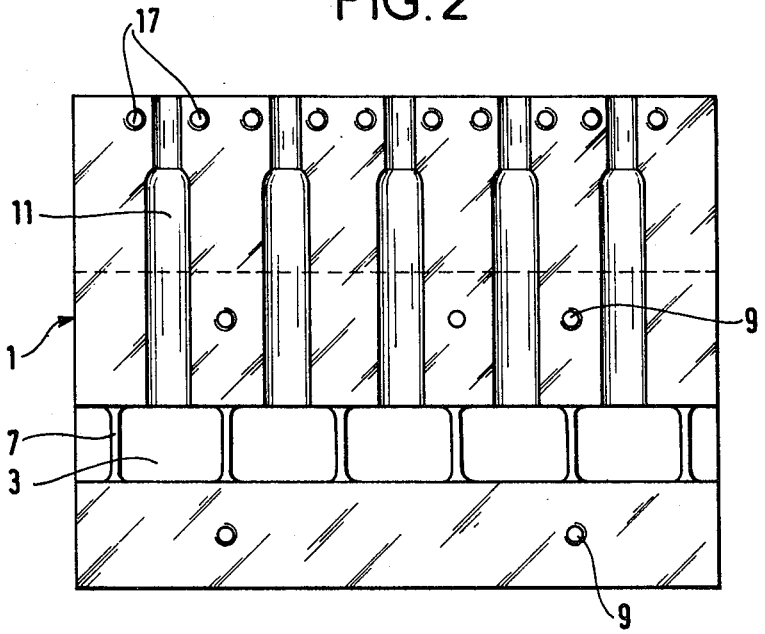
FIGS. 2 and 3 are views in elevation of the two parts constituting the filter.
Figure 3:
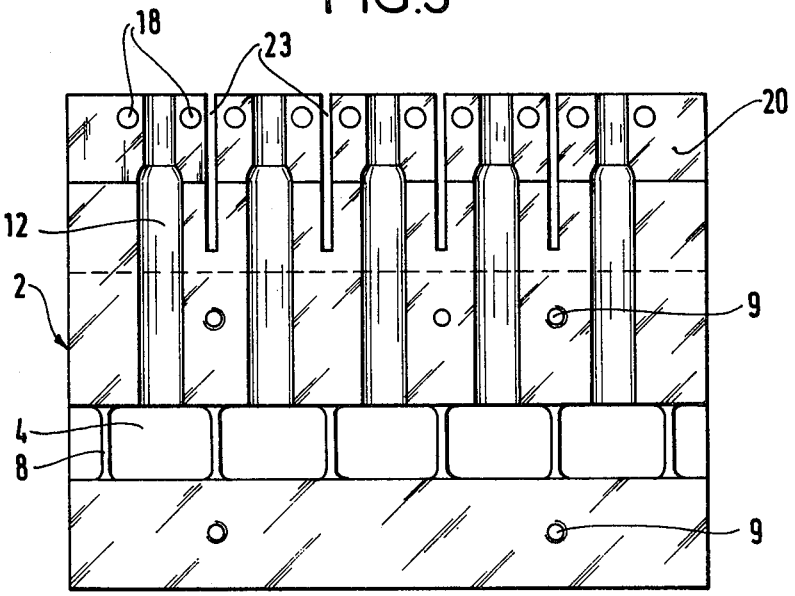

Referring to FIGS. 1, 2 and 3, the microwave filter is fabricated in two parts 1 and 2 mating together at the longitudinal median plane of the filter and together defining the filter body. Each of parts 1 and 2 comprises a row of recesses 3 and 4 machined into the mating faces, defining in the assembled filter a plurality of resonant cavities such as cavity 5, coupled to one another and to the half-cavities at the ends by coupling apertures such as aperture 6. These coupling apertures, of rectangular shape in this instance, are defined by partitions such as partitions 7 and 8 separating the recesses in each row from one another and positioned in face-to-face relationship in the assembled filter.

The two parts 1 and 2 of the filter are made from a material which is easy to machine, such as aluminum, for example. They are assembled together by means of screws and/or centering pins inserted in pairs of holes 9 formed in the filter body on either side of the resonant cavities.

Figure 4:
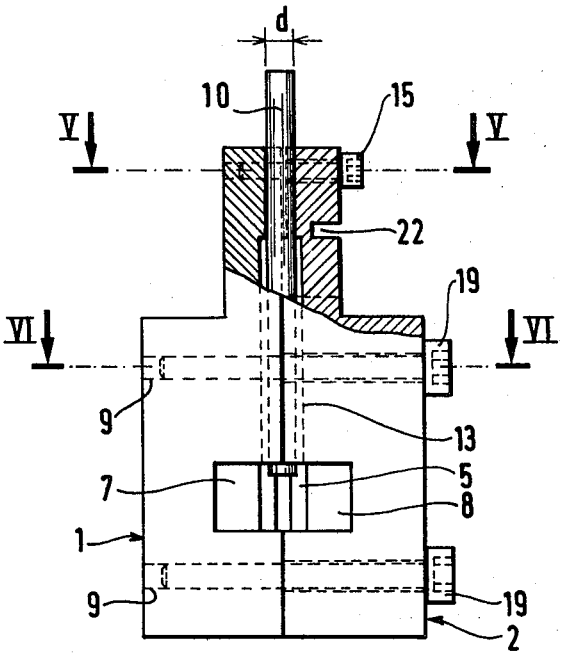
FIG. 4 is a side view of the filter.

As also seen in FIG. 4, each of resonant cavities 5 is tuned by a cylindrical tuning rod 10 made from a thermally stable material such as quartz, for example. A first end of each rod 10 extends into the cavity and is maintained in position therein by fastening the opposite end of the rod to the body 1-2 of the filter. The diameter of the tuning rods and the position of the point at which each is anchored relative to the center of the cavity are determined to achieve the required compensation against drift of the filter frequency with temperature, the variations in the cavity dimensions (length and width) with temperature being compensated by the displacement within the cavities of the rods, the dimensions of which are substantially invariable but which are fixed into the filter body at a distance from the respective cavities.

For the purposes of inserting each tuning rod into the respective cavity, parts 1 and 2 each comprise a series of semi-circular grooves 11 and 12 machined into the mating surfaces of these parts and opening into recesses 3 and 4, respectively. Grooves 11 and 12 are in face-to-face relationship in pairs in the assembled filter, defining a series of bores 13 opening into respective resonant cavities 5. To retain each rod in position, the end portion of each bore opposite the cavity is of substantially the same diameter d as the rods, the bores being of greater diameter over the remainder of their length than the rods with which they are in contact over these end portions. The end portions of the bores, of diameter substantially equal to diameter d, define in filter body 1-2 the area in which the tuning rods are fastened. Each rod is individually fastened into the end portion of the bore accommodating it by means of two retaining screws 15 disposed transversely and one on each side of the rod 10 in question.

To this end, each of the two parts 1 and 2 of the filter body has, on each side of each of its grooves 11 and 12 and in the vicinity of the longitudinal edge into which the grooves open, two bores 17 and 18 disposed transversely to the grooves, through which the shanks of the two retaining screws 15 pass. In one of the two parts of the filter body, part 2 in this case, bores 18 are of greater diameter than the shanks of the screws they accommodate, the shanks of the screws being freely movable within these clearance holes whereas their heads come into abutting contact with the external surface of this part 2. In the other part 1, the bores 17 are threaded to match the shanks of the screws, at least the ends of which are correspondingly threaded. Thus the retaining screws are anchored into these threaded bores 17.

The internal surface of one of parts 1 and 2 of the filter also has, along its length and projecting slightly in the direction of the height of the bore portions 13 of diameter substantially equal to that of rods 10, a clearance notch 20 which, in the assembled filter, defines a longitudinal clearance groove 21 at least over the height of the rod fastening area, the surfaces of parts 1 and 2 being in mating contact with one another elsewhere.

Groove 21 may instead be formed, in a non-illustrated alternative embodiment, by means of recesses formed on the internal surfaces of both parts 1 and 2.

In this filter, the retaining screws to either side of each tuning rod clamp both parts 1 and 2 around the tuning rod 10 in question, extending into the cavity. Experience shows that the line at which each of tuning rods 10 is anchored is situated at the intersection of the rod with the plane defined by the axes of the retaining screws 15 associated therewith.

As is seen clearly in FIG. 1, part 2 of the filter in which the bores for retaining screws 15 are wide to provide clearance for the shanks of these screws also has a longitudinal groove 22 on its outside surface, delimiting the height of the area in which rods 10 are fastened in filter body 1-2. This part 2 also has a series of transverse grooves 23 separating the pairs of retaining screws 15 fastening the various tuning rods 10 from one another in this part 2 by dividing it, at least over the height of the fastening area, into individual supports for tuning rods 10. In the embodiment shown, these grooves 23 intersect longitudinal groove 22 and extend over the height of the fastening area for tuning rods 10.

Because of the clearance groove 21, the series of transverse grooves 23 and the longitudinal groove 22 in part 2 of the filter body, the forces fastening the various tuning rods 10 into the filter body are virtually independent of one another. In particular, the pressure clamping each rod into its respective bore is individually controllable, so that this pressure may be made substantially equal from one rod to the next.

Figure 5:
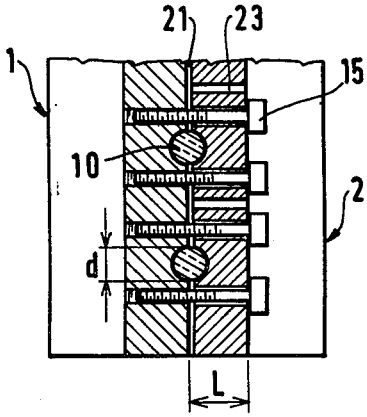
FIGS. 5 and 6 are cross-sections on the lines V—V and VI—VI in FIG. 4, respectively.
Figure 6:
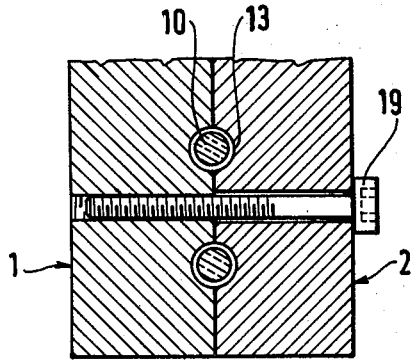

FIGS. 5 and 6 are two cross-sections through the filter, in the longitudinal area in which the tuning rods are fastened and in an area intermediate this fastening area and the cavity area, respectively. These figures show clearly that tuning rods 10 are fastened between parts 1 and 2 in the portions of the bores having the same diameter, by means of the pairs of retaining screws 15, whereas tuning rods 10 are not in contact with bores 13 outside this fastening area.

The figures also show that parts 1 and 2 are, especially in the area in which the tuning rods are fastened in the resulting bores, of reduced thickness as compared to the area in which recesses 3 and 4 are formed. The filter is thus of generally rectangular parallelepiped shape, including the row of resonant cavities 5 and accommodating the screws and/or centering pins referenced 19 assembling its parts 1 and 2, and which is surmounted by a median longitudinal support of significantly less thickness (by a ratio of 3:1 in the example shown), in which the tuning rods are fastened remotely of the cavities. This structure is easy to implement, requiring only mechanical machining operations.

Further in accordance with the invention, retaining screws 15 and the end portions of bores 13 or tuning rods 10 are dimensioned so that the ratio of the length L of that portion of each retaining screw between its head and its anchor point in part 1 of the filter to the diameter d of the bores in the fastening area or the the tuning rods is substantially equal to the ratio of the coefficient of linear expansion of the material of the filter body to the difference between that coefficient and the coefficient of linear expansion of the material of the shanks of the retaining screws, this material naturally being chosen so that its coefficient of linear expansion is less than that of the material constituting the filter body. As can be seen in FIG. 4, in which the shanks of retaining screws 15 are anchored directly into the inner surface of part 1 while their heads are in abutment contact with the outside surface of part 2 of the filter, the length L of the relevant parts of the shanks of the retaining screws defines the thickness of part 2, including the width of groove 21, in this fastening area.

By way of example, in a filter with body 1-2 of aluminum, tuning rods 10 of quartz and retaining screws 15 of steel, the coefficients of linear expansion of aluminum and steel being $22\times10^{-6}$ and $15\times10^{-6}$, respectively, the aforementioned length L would be approximately 12.5 mm for a bore or tuning rod diameter of substantially 4 mm.

Under these conditions, in the event of variations in ambient temperature, the variation in the length L of the relevant parts of the retaining screws clamping the internal surfaces of parts 1 and 2 against the tuning rod maintains practically constant the diameter of the bores in which the tuning rods are fastened, irrespective of the thermal stresses to which the filter body is subjected. Thus the tuning rods are held in the filter body at a pressure which remains substantially constant in spite of varying temperature conditions, preventing them bursting or loosening with variations in temperature.

It will be understood that various changes in the details, materials and arrangements of parts, which have been herein described and illustrated in order to explain the nature of the invention, may be made by those skilled in the art within the principle and scope of the invention as expressed in the appended claims.

It is claimed:

1. A microwave filter comprising; a filter body, resonant cavities machined into said filter body and coupled to one another, a respective tuning rod for each of said cavities fabricated from a thermally stable material and having a first end extending into the respective cavity without touching the surface thereof, bores in said filter body which open onto one of its surfaces and into one of said cavities, end portions of said bores opposite said cavities having a diameter substantially equal to the diameter of said tuning rods, and means for clamping a second end of each of said rods into said end portion of said bore accommodating it under substantially constant clamping pressure irrespective of temperature variation.

2. A microwave filter according to claim 1, comprising a longitudinal clearance groove within said filter body intersecting said end portions of said bores substantially coincident with their median axis and extending over their full height.

3. A microwave filter according to claim 2, wherein said filter body comprises opposing parts and wherein said clamping means comprise transversely disposed retaining screws on each side of each of said tuning rods in the area of said end portions of said bores accommodating said tuning rods, said screws passing through clearance holes within one body part on one side of said groove and being threaded into retaining holes within the other body part on the other side of said groove aligned with said clearance holes.

4. A microwave filter according to claim 3, wherein said retaining screws and said end portions of said bores are so dimensioned that the ratio of the length of that portion of each retaining screw between its head and its anchor point to the diameter of said end portions of said bores is substantially equal to the ratio of the coefficient of linear expansion of the material of said filter body to the difference between that coefficient and the coefficient of linear expansion of the material of said retaining screws, which has a coefficient of linear expansion less than that of the material of said filter body.

5. A microwave filter according to claim 4, wherein said filter body has a series of transverse grooves on that side of said groove on which lie said clearance holes for said retaining screws, separating said end portions of said bores from one another.

* * * * *